US012385721B2

(12) United States Patent
Bigby et al.

(10) Patent No.: US 12,385,721 B2
(45) Date of Patent: Aug. 12, 2025

(54) MODULAR ILLUMINATION AND AIMING APPARATUS WITH MOUNTING MODULE HAVING DIFFERENT MOUNTING ORIENTATIONS

(71) Applicant: B.E. Meyers & Co., Inc., Redmond, WA (US)

(72) Inventors: Alexander Bigby, Redmond, WA (US); Thomas Alldredge, Seattle, WA (US); Matthew Meyers, Preston, WA (US)

(73) Assignee: B.E. Meyers & Co., Inc., Redmond, WA (US)

( * ) Notice: Subject to any disclaimer, the term of this patent is extended or adjusted under 35 U.S.C. 154(b) by 0 days.

(21) Appl. No.: 18/629,290

(22) Filed: Apr. 8, 2024

(65) Prior Publication Data

US 2024/0255256 A1 Aug. 1, 2024

Related U.S. Application Data

(63) Continuation of application No. 18/183,918, filed on Mar. 14, 2023, now Pat. No. 11,982,509, which is a (Continued)

(51) Int. Cl.

| | |
|---|---|
| ***F41G 11/00*** | (2006.01) |
| ***F41G 1/35*** | (2006.01) |
| ***F41G 1/36*** | (2006.01) |

(52) U.S. Cl.

CPC ..... *F41G 11/001* (2013.01); *F41G 1/35* (2013.01); *F41G 1/36* (2013.01)

(58) Field of Classification Search

CPC ..... F41G 1/35; F41G 1/36; F41G 1/34; F41G 1/345; F41G 11/001

(Continued)

(56) References Cited

U.S. PATENT DOCUMENTS

| | | | |
|---|---|---|---|
| 5,345,707 | A | 9/1994 | Randall |
| 6,196,702 | B1 | 3/2001 | Krietzman |

(Continued)

OTHER PUBLICATIONS

Requirement for Restriction/Election received for U.S. Appl. No. 29/802,702, dated Apr. 18, 2023, 48 pages.

(Continued)

*Primary Examiner* — Robert J May

(74) *Attorney, Agent, or Firm* — Amin, Turocy & Watson, LLP

(57) ABSTRACT

A modular illumination and aiming apparatus, an example of which includes an optical head module, mounting module, and an end cap module. The modular illumination and aiming apparatus is configured to be quickly and intuitively adjusted by a user in response to changing target and environmental conditions. The modular illumination and aiming apparatus is configured to be ergonomically supportive such that a user may maintain a consistent firing grip while activating the illumination and aiming functions. The optical head module is configured to allow the user to change radiation types by adjusting an end cap. The alignment mechanism in the optical head module for the radiation source and optics is configured to provide a robust and zero-play optical mount in order to resist recoil and general physical shock.

20 Claims, 7 Drawing Sheets

Related U.S. Application Data continuation of application No. 17/388,454, filed on Jul. 29, 2021, now Pat. No. 11,629,935, which is a continuation of application No. 16/996,680, filed on Aug. 18, 2020, now Pat. No. 11,105,590, which is a continuation of application No. 16/459,761, filed on Jul. 2, 2019, now Pat. No. 10,782,100, which is a continuation of application No. 15/142,597, filed on Apr. 29, 2016, now Pat. No. 10,386,160.

(60) Provisional application No. 62/155,964, filed on May 1, 2015.

(58) Field of Classification Search
USPC ..... 362/110
See application file for complete search history.

(56) References Cited

U.S. PATENT DOCUMENTS

| | | | | |
|---|---|---|---|---|
| 6,450,816 | B1 | 9/2002 | Gerber | |
| 6,513,251 | B2 | 2/2003 | Huang et al. | |
| 6,609,810 | B2 | 8/2003 | Kim | |
| 6,714,564 | B1 | 3/2004 | Meyers | |
| 7,264,369 | B1 | 9/2007 | Howe | |
| 7,726,061 | B1 | 6/2010 | Thummel | |
| 7,784,192 | B2 | 8/2010 | Jancic et al. | |
| 7,936,511 | B2 | 5/2011 | Meyers et al. | |
| 7,997,022 | B2 | 8/2011 | Morin et al. | |
| 8,056,245 | B2 | 11/2011 | Cranton et al. | |
| 8,117,782 | B2 | 2/2012 | Gross et al. | |
| 8,156,679 | B1 | 4/2012 | Swan | |
| 8,182,109 | B2 | 5/2012 | Matthews et al. | |
| D667,580 | S | 9/2012 | Lee | |
| D667,581 | S | 9/2012 | Lee | |
| 8,287,157 | B2 | 10/2012 | Sharrah et al. | |
| 8,336,776 | B2 | 12/2012 | Horvath et al. | |
| D682,977 | S | 5/2013 | Thummel et al. | |
| D696,377 | S | 12/2013 | Thummel et al. | |
| 9,243,870 | B2 | 1/2016 | Teetzel et al. | |
| 9,341,348 | B2 | 5/2016 | Keser et al. | |
| 9,395,066 | B2 | 7/2016 | Nemeyer | |
| 9,766,038 | B2 | 9/2017 | Toole | |
| 9,772,163 | B2 * | 9/2017 | Sharrah | H05B 45/3725 |
| D821,621 | S | 6/2018 | Noble | |
| 10,012,474 | B2 | 7/2018 | Teetzel et al. | |
| 10,386,160 | B2 | 8/2019 | Bigby | |
| D867,630 | S | 11/2019 | Benoit | |
| D869,036 | S | 12/2019 | Brockie | |
| D880,740 | S | 4/2020 | Galli | |
| D891,665 | S | 7/2020 | Nagano | |
| D908,275 | S | 1/2021 | Galli | |
| D936,260 | S | 11/2021 | Galli | |
| D967,919 | S | 10/2022 | Lai | |
| D970,765 | S | 11/2022 | Li | |
| 2008/0043322 | A1 | 2/2008 | Sauter et al. | |
| 2010/0283404 | A1 | 11/2010 | Thoren, Sr. | |
| 2015/0308787 | A1 | 10/2015 | Cheng et al. | |
| 2016/0341521 | A1 | 11/2016 | Bigby | |
| 2016/0348880 | A1 | 12/2016 | Galli | |
| 2020/0064102 | A1 | 2/2020 | Galli | |
| 2023/0228531 | A1 | 7/2023 | Bigby et al. | |

OTHER PUBLICATIONS

Nathan S., "BE Meyers Releases Civilian Legal MAWL-C1+", TFB Newsletter, Retrieved from the Internet: <https://www.thefirearmblog.com/blog/2017/03/20/meyers-releases-civilian-legal-mawl-c1/>, Mar. 20, 2017, 7 pages.

Nicholas C., Friday Night Lights: How to Zero Your Invisible Laser (AKA Infrared Laser), TFB Newsletter, Retrieved from the Internet: <https://www.thefirearmblog.com/blog/2020/03/27/how-to-zero-your-invisible-laser/>, Mar. 27, 2020, 15 pages.

Non-Final Office Action received for U.S. Appl. No. 29/802,702, dated Aug. 11, 2023, 9 pages.

Non-Final Office Action received for U.S. Appl. No. 16/996,680, dated Oct. 7, 2020, 28 pages.

Notice of Allowance received for U.S. Appl. No. 16/996,680, dated Apr. 29, 2021, 16 pages.

Non-Final Office Action received for U.S. Appl. No. 16/459,761, dated Mar. 2, 2020, 25 pages.

Notice of Allowance received for U.S. Appl. No. 16/459,761, dated May 18, 2020, 12 pages.

Non-Final Office Action received for U.S. Appl. No. 15/142,597, dated Sep. 7, 2017, 22 pages.

Final Office Action received for U.S. Appl. No. 15/142,597, dated Mar. 12, 2018, 16 pages.

Non-Final Office Action received for U.S. Appl. No. 15/142,597, dated Aug. 3, 2018, 17 pages.

Notice of Allowance received for U.S. Appl. No. 15/142,597, dated Apr. 3, 2019, 14 pages.

Non-Final Office Action received for U.S. Appl. No. 17/388,454, dated Jun. 3, 2022, 33 pages.

Notice of Allowance received for U.S. Appl. No. 17/388,454, dated Dec. 15, 2022, 12 pages.

Ex Parte Quayle Action received for U.S. Appl. No. 29/802,702, dated Nov. 30, 2023, 13 pages.

Non Final Office Action received for U.S. Appl. No. 18/183,918 dated Dec. 4, 2023, 38 pages.

Notice of Allowance received for U.S. Appl. No. 18/183,918, dated Feb. 27, 2024, 20 pages.

Notice of Allowance received for U.S. Appl. No. 29/802,702, dated Mar. 5, 2024, 16 pages.

* cited by examiner

| Range | Button | Emitter | Power | Range | Notes |
|---|---|---|---|---|---|
| LONG | Front (KILL) | Aiming Pointer<br>Illuminator-4 deg<br>Illuminator-16 deg<br>Illuminator-60 deg | 15 mW<br>150 mW<br>-<br>- | ~1000 m<br>~400 m<br>-<br>- | High Power Pointer and High Power Narrow Illuminator for exterior use from 100 m to 400m |
| | Rear (ADMIN) | Aiming Pointer<br>Illuminator-4 deg<br>Illuminator-16 deg<br>Illuminator-60 deg | 15 mW<br>-<br>-<br>- | ~1000 m<br>-<br>-<br>- | High Power Pointer with NO Illuminator intended for exterior use in targeting, communication, and direction from 50 m to 1000 m+ |
| MID | Front (KILL) | Aiming Pointer<br>Illuminator-4 deg<br>Illuminator-16 deg<br>Illuminator-60 deg | 10 mW<br>20 mW<br>150 mW<br>- | ~500 m<br>~175 m<br>~100 m<br>- | Medium Power Pointer with High Power Wide Spill Illuminator and Low Power "Hot Spot" intended for exterior use from 0 m to 100 m |
| | Rear (ADMIN) | Aiming Pointer<br>Illuminator-4 deg<br>Illuminator-16 deg<br>Illuminator-60 deg | 10 mW<br>80 mW<br>40 mW<br>- | ~500 m<br>~150 m<br>~50 m<br>- | Medium Power Pointer with High Power Narrow Illuminator and Low Power Wide Spill intended for exterior use from 50 m to 150 m |
| SHORT | Front (KILL) | Aiming Pointer<br>Illuminator-4 deg<br>Illuminator-16 deg<br>Illuminator-60 deg | 1 mW<br>-<br>-<br>40 mW | ~100 m<br>-<br>-<br>~15 m | Low Power Pointer and Smooth Illuminator intended for interior use from 0 m to 15 m |
| | Rear (ADMIN) | Aiming Pointer<br>Illuminator-4 deg<br>Illuminator-16 deg<br>Illuminator-60 deg | -<br>-<br>-<br>5 mW | -<br>-<br>-<br>~5 m | Navigation Light Intended for covert maneuvering through difficult terrain |

FIG. 6

MODULAR ILLUMINATION AND AIMING APPARATUS WITH MOUNTING MODULE HAVING DIFFERENT MOUNTING ORIENTATIONS

RELATED APPLICATIONS

The subject patent application is a continuation of U.S. application Ser. No. 18/183,918, filed Mar. 14, 2023, which is a continuation of U.S. application Ser. No. 17/388,454, filed Jul. 29, 2021, which issued as U.S. Pat. No. 11,629,935 and is a continuation of U.S. application Ser. No. 16/996,680, filed Aug. 18, 2020, which issued as U.S. Pat. No. 11,105,590 and is a continuation of U.S. application Ser. No. 16/459,761, filed Jul. 2, 2019, which issued as U.S. Pat. No. 10,782,100 and is a divisional application of U.S. application Ser. No. 15/142,597, filed Apr. 29, 2016, which issued as U.S. Pat. No. 10,386,160, all of which patent applications claim priority to U.S. provisional patent application No. 62/155,964, filed May 1, 2015. The entireties of all of these priority applications, i.e., all of the non-provisional applications and the provisional application listed as priority applications in this paragraph, are hereby incorporated by reference herein.

TECHNICAL FIELD

This subject application relates to combined illumination and laser aiming apparatuses, which may be mounted to weapons, for example, firearms.

BACKGROUND

Weapon-mounted aiming and illumination apparatuses allow users to rapidly acquire, identify, and engage targets in combat situations. These apparatuses are generally configured to allow for both aiming and illuminating operation in both daytime and nighttime scenarios. As such, these apparatuses often include illumination and aiming laser radiation that is detectable in both the visible and invisible spectrum. Because a user may engage with a target at a variety of distances, these apparatuses are generally configured to be operable in both short-range, immediate combat situations, and longer-range, distant target engagements. These apparatuses may also be used to visually communicate with allies or other non-combatant users over a distance. For example, in a nighttime situation, friendly users may use infrared illumination in combination with night-vision systems in order to communicate with, or identify potential targets to, one another.

Prior art illumination and aiming systems and apparatuses, while adjustable to different distance and illumination settings, have failed to provide users with intuitive and simple controls that would allow a user to rapidly adjust an illumination and aiming device to appropriate settings for a given situation and environment. Prior art systems are also cumbersome in size and shape, altering the characteristics of a user's weapon; lack any ergonomic or intuitive features to facilitate usage; and do not provide users with sufficient customization and mounting options.

There exists a need for an illumination and aiming apparatus that will allow a user to rapidly adjust the settings of the illumination and aiming functions in response to target position and environmental conditions for a particular engagement, without requiring the user to alter or adjust firing grip, or spend unnecessary time adjusting and changing illumination and aiming settings. There is also a need for an illumination and aiming apparatus that is modular and highly adaptable to a user's specific mission and environmental requirements. Further, there is a need for a compact and accurate apparatus for adjusting the illumination direction that does not change during use.

SUMMARY

The following presents a simplified summary of the disclosed subject matter in order to provide a basic understanding of some aspects of the disclosed subject matter. This summary is not an extensive overview of the disclosed subject matter. It is intended to neither identify key or critical elements of the disclosed subject matter nor delineate the scope of the disclosed subject matter. Its sole purpose is to present some concepts of the disclosed subject matter in a simplified form as a prelude to the more detailed description that is presented later.

The present application describes a robust, customizable, modular, compact, accurate, and ergonomic illumination and aiming apparatus configurable to be mounted on a variety of objects, including, but not limited to, a weapons system, such as a firearm. In other embodiments, the illumination and aiming apparatus may be hand-held, helmet-mounted, or vehicle-mounted.

It is an object of example embodiments of the present application to provide an illumination and aiming apparatus that presents a user with intuitive and quick adjustment options in response to specific environmental and targeting conditions. It is a further object of example embodiments of the present application to allow for modular customization of the functionality and ergonomics of the illumination and aiming apparatus by allowing the user to interchange various modular components, including for example, optical components, power units, and mounting components, among others.

Example embodiments of the present application also provide a robust, compact, and stable optical assembly for illumination and aiming optics that allows a user to ensure accuracy and repeatability of operation of the illumination and aiming apparatus.

Example embodiments of the present application further provide seals between apparatus components that shield internal and electrical optical components from harmful environmental conditions.

Example embodiments of the present application further provide magnetic switches that allow a user to change the modes of the illumination and aiming apparatus without exposing any internal optical or electrical components to environmental degradation. In one example embodiment, a Hall-effect sensor is provided in the lens cap of the optical head module to allow the user to change between visible radiation, invisible radiation, and off-state modes.

Example embodiments of the present application also provide a compact solution for implementing different illumination modes of the illumination and aiming apparatus by providing, in one example embodiment, a vertical cavity surface emitting laser ("VCSEL") array for the illumination source in the optical head module.

BRIEF DESCRIPTION OF THE DRAWINGS

The accompanying drawings are fully incorporated in, and form part of, this specification, and illustrate example embodiments of the subject application that, together with the description, serve to explain principles of the example embodiments:

FIG. 6 illustrates an example table of function sets for different modes of an example embodiment of a modular illumination and aiming apparatus.

DETAILED DESCRIPTION

Reference will now be made in detail to embodiments of the application, examples of which are illustrated in the accompanying drawings. While various details are described in conjunction with these embodiments, it will be understood that the descriptions herein are not intended to limit the scope of coverage to these example embodiments. On the contrary, the example embodiments are intended to cover alternatives, modifications, and equivalents that may be included within the spirit and scope of coverage as defined by the appended claims. Detailed description of components that are well known in the art may be omitted if that detailed description would confuse or obscure the description of the embodiments of the present application.

Figure 1A:
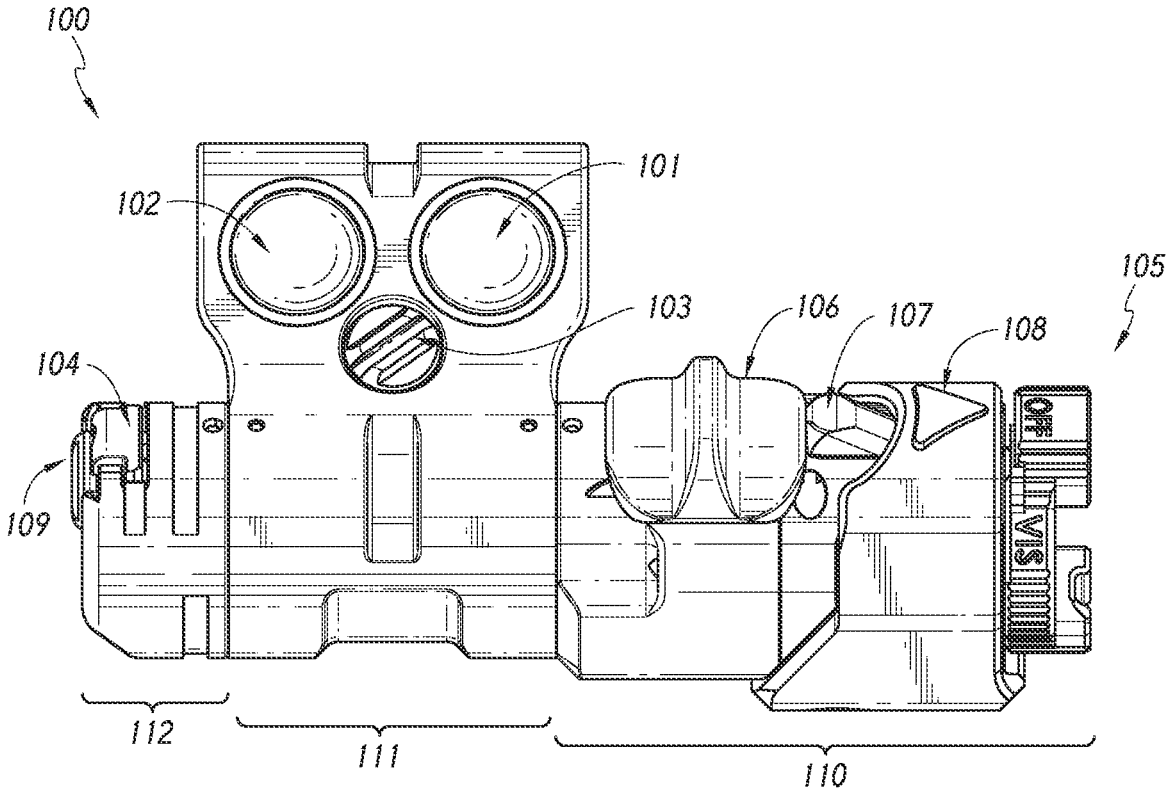
FIGS. 1A and 1B depict an example embodiment of a fully assembled modular illumination and aiming apparatus.
Figure 1B:
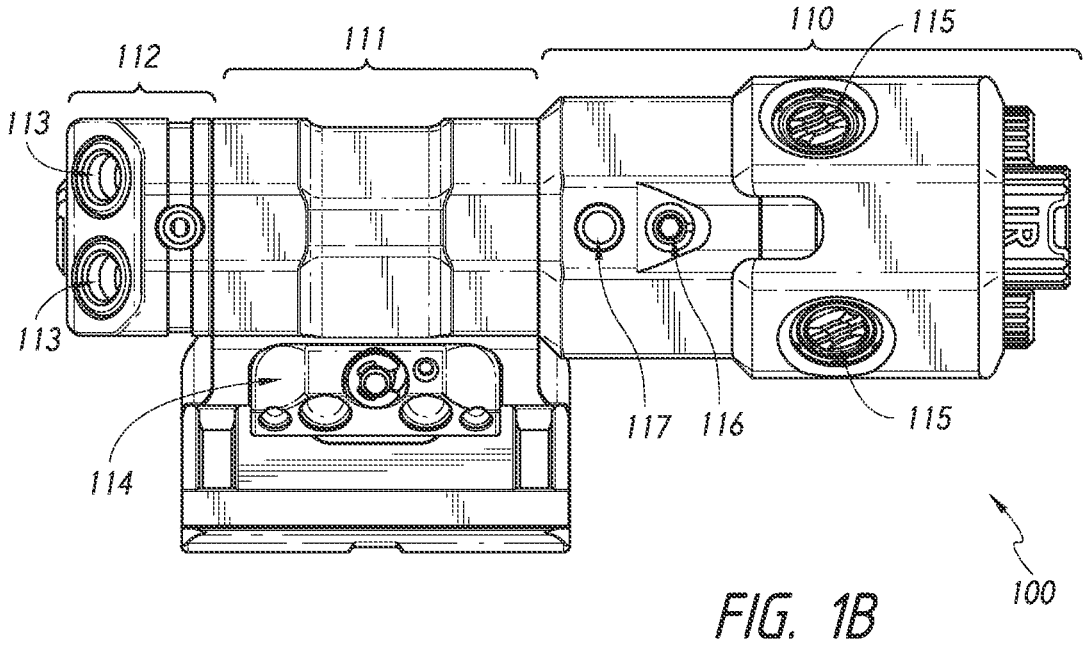

FIGS. 1A and 1B depict an example embodiment of a fully-assembled, modular illumination and aiming apparatus 100 from a top and bottom view perspective. Illumination and aiming apparatus 100 comprises the combination of optical head module 110, mounting module 111, and end cap module 112. Modules 110, 111, and 112 may be aligned by means of an internal alignment mechanism. Modules 110, 111, and 112 may also be configured to be in electrical connection with one another. The connections between modules 110, 111, and 112 may be sealed off from the environment, for example, by o-ring gaskets. Specific features of optical head module 110, mounting module 111, and end cap module 112 may each be described in more detail below with respect to other figures.

In general, optical head module 110 may contain multiple radiation sources, including, for example, both infrared and visible radiation sources. In one example embodiment, the multiple radiation sources may comprise an array of VCSEL elements. In one example embodiment, the user may toggle between radiation sources by changing or rotating the position of lens cap 105. In some embodiments, lens cap 105 may be a propeller cap that is configured to rotate to different positions that correspond to different illumination modes. In some embodiments, lens cap 105 may include magnets that activate Hall-effect sensors in optical head module 110 that are configured to activate and deactivate different radiation sources within optical head module 110. Lens cap 105 may also be configured to cover and protect radiation apertures that correspond to inactive radiation modes. For example, when lens cap 105 is positioned in an "off" position, the radiation apertures for both the invisible and visible modes will be at least partially covered and protected. When lens cap 105 is in the position that corresponds to the visible radiation mode, the radiation apertures for the invisible radiation mode will be at least partially covered and protected, while the radiation apertures for the visible radiation will be exposed. When lens cap 105 is in the position that corresponds to invisible radiation mode, the radiation apertures for the visible mode will be at least partially covered and protected, while the radiation apertures for the invisible radiation will be exposed. Mode indicator 108 may be configured to indicate the position of lens cap 105, thus indicating to the user the current radiation mode configuration of illumination and aiming apparatus 100. In other example embodiments, optical head 110 may include multiple visible and invisible radiation modes that may be selected by positioning lens cap 105, e.g., green and red visible light modes.

Optical head module 110 may also include a range switch 106 that allows a user to select a range mode, depending on the distance from which the user is engaging a target or depending on the environment in which the user finds himself. In some embodiments, range switch 106 may be a linear, three-position switch that allows a user to toggle between short-range, mid-range, and long-range illumination and aiming modes. The switch may be configured to provide tactile feedback to the user to confirm the mode to the user. Range switch 106 may work in combination with lock-out switch 107 to prevent a user from inadvertently switching the device into a long range mode. In some embodiments, a user may be required to depress lock-out switch 107 in order to move range switch 106 into a position that activates the long-range mode. The user may select the position of range switch 106 in combination with the position of lens cap 105 in order to configure illumination and aiming apparatus 100 with the appropriate radiation and range modes for the user's particular environment and distance to a target.

Optical head module 110 may also include a rubberized covering in order to protect illumination and aiming apparatus 100 from shocks, scratches, dents, and/or physical damage. Similar protective coatings or coverings may be provided to protect the other modules that are combined to form illumination and aiming apparatus 100.

Optical head module 110 may include adjustment screws 115 for adjusting the alignment of the optical assembly that includes the radiation sources, including adjustments to both azimuth and elevation. Optical head module 110 may also include positive contact or terminal 218 for the voltage source that may be housed in mounting module 111. Optical head module 110 may also include a training mode switch. In one example embodiment, the training mode switch may comprise engagement ports 116 and 117 configured to allow a user to toggle illumination and aiming apparatus 100 into a training mode by moving a set screw from one training engagement port to the other. In one example embodiment, configuring the illumination and aiming apparatus into training mode may reduce the power of the illumination and aiming apparatus.

In general, mounting module 111 may include mounting hardware, activation buttons, and may also be configured to house an electrical power source for supplying a voltage to the radiation sources, for example, a lithium ion battery. Mounting module 111 may also include activation buttons 101 and 102, and mount screw 103. Activation buttons 101 and 102 may be configured to provide a user with different operation functions for illumination and aiming apparatus 100. These operation functions may depend on the settings the user has selected for the type of radiation and the range to the target by way of lens cap 105 and range switch 106, respectively. For example, for a given radiation and range setting, activation button 101 may activate a first operation function comprising a continuous aiming pointer and a higher power illumination beam, while activation button 102 may activate a second operation function comprising a pulsed aiming pointer and a lower power illumination beam. In an example embodiment, activation buttons 101 and 102 may be double clicked to enable illumination and aiming apparatus 100 to remain in a continuous "on" state for a given operation function. In other example embodiments, triple clicks on activation buttons 101 and 102 may provide a user with additional functionalities.

Activation buttons 101 and 102 may have a low-profile height that will allow a user to maintain a comfortable and effective firing grip while activating illumination and aiming apparatus 100. In other example embodiments, additional or fewer activation buttons may be provided on mounting module 111 in order to provide a user with additional or fewer operation function options. In some example embodiments, mounting module 111 allows the bulk of the illumination and aiming apparatus 100 to be mounted off-axis from the central axis of a firearm so that interference between any additional adjacent components may be prevented (e.g., white light source, powered optics, etc.). Similarly, in some example embodiments, mounting module 111 allows activation buttons 101 and 102 to be mounted on axis with the firearm, so that the user may easily locate and activate illumination and aiming apparatus 100.

Mount screw 103 may be configured, in combination with other hardware, to allow a user to clamp, or mount, illumination and aiming apparatus 100 to an object. In one example embodiment, mount screw 103 may be connected to a rail grabber 114 that is configured to mount illumination and aiming apparatus 100 to a 1913 Picatinny rail system or other alternative rail systems. In other example embodiments, mount screw 103 may be connected to a clamping system appropriate for mounting to a helmet, vehicle, or other firearm. In further example embodiments, mount screw 103 may be configured to match the thread and diameter of a mounting hole provided on an object upon on which illumination and aiming apparatus 100 is to be directly mounted.

Because illumination and aiming apparatus 100 may be mounted in a number of orientations (e.g., left-handed or right-handed directions), it is understood that the functionalities provided by activation buttons 101 and 102 may remain in the same order relative to the user. For example, in a first mounting orientation, activation button 102 may be closest to the user and may provide a first operation function, while activation button 101 may be further from the user and may provide a second operation function. In a second mounting orientation, where activation button 101 is closest to the user, and activation button 102 is further from the user, activation button 101 may provide the first operation function while activation button 102 may provide the second operation function. In this way, the operation functions of activation buttons 101 and 102 may be configured to remain consistent across all orientations. This allows illumination and aiming apparatus 100 to be configured to accommodate both right-handed and left-handed user preferences.

In general, end cap module 112 may include latching hardware and ports for remote activation systems. In one example, end cap module 112 may include end cap screw 109, end cap latch 104, and remote fire switch ports 113. End cap latch 104 may be configured to engage with a set of alignment rails that are attached to optical head module 110 and extend internally through the body of mounting module 111. End cap screw 109 may be configured to allow a user to fix the position of end cap latch 104 through tightening. Once end cap latch 104 is engaged with the alignment rails, this may allow the user to fix the combination of modules that comprise illumination and aiming apparatus 100 by tightening end cap screw 109.

End cap module 112 may also include remote fire switch ports 113 that are configured to allow the user to activate illumination and aiming apparatus 100 remotely. In one example embodiment a user may attach tape switches to remote fire switch ports 113 in order to configure illumination and aiming apparatus 100 for remote activation.

End cap module 112 may also include the negative terminal or contact for the voltage source that may be housed in mounting module 111.

Figure 2A:
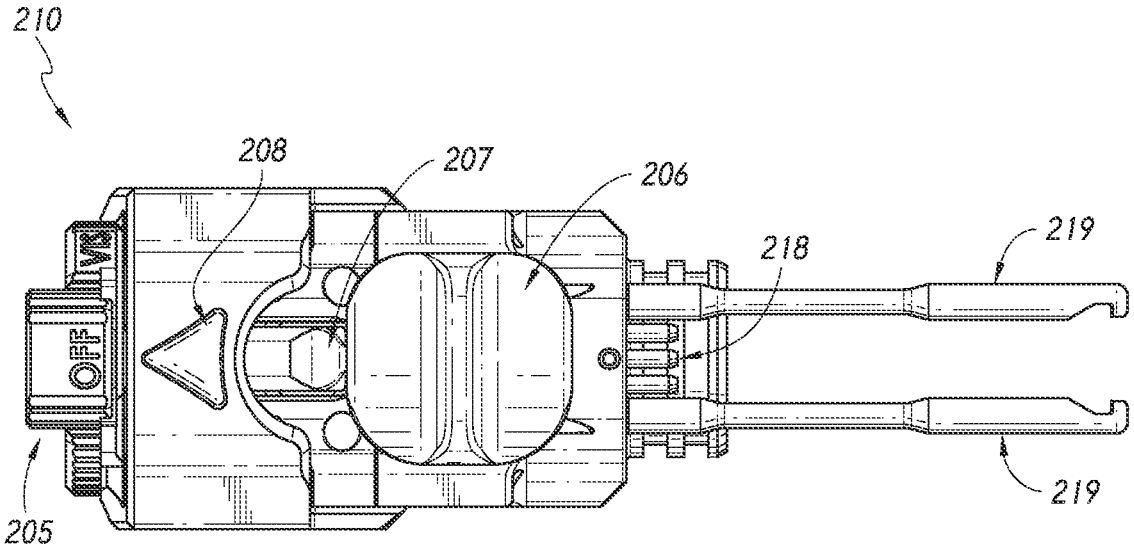
FIGS. 2A and 2B depict an example embodiment of an optical head module.
Figure 2B:
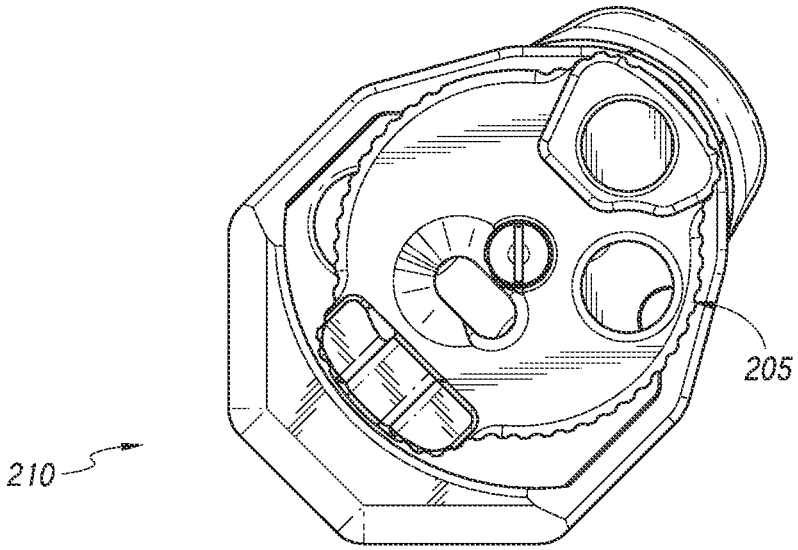

FIGS. 2A and 2B depict an example optical head module 210 configured to be combined with other modular components to form an illumination and aiming apparatus. As described above with respect to FIGS. 1A and 1B, an example embodiment of an optical head module may include lens cap 205, range switch 206, lock-out switch 207, and mode indicator 208.

Optical head module 210 may also include alignment rails 219 that are, upon insertion, configured to align optical head module 210 with other modules in a fully combined illumination and aiming apparatus. Alignment rails 219 are also configured to engage with an end latch in an end cap module, in order to allow a user to fix the arrangement of modules. Optical head module 210 also includes electrical contacts 218 that may be configured to provide electrical connections between optical head module 210 and the other modules that comprise a fully assembled illumination and aiming apparatus.

Figure 3:
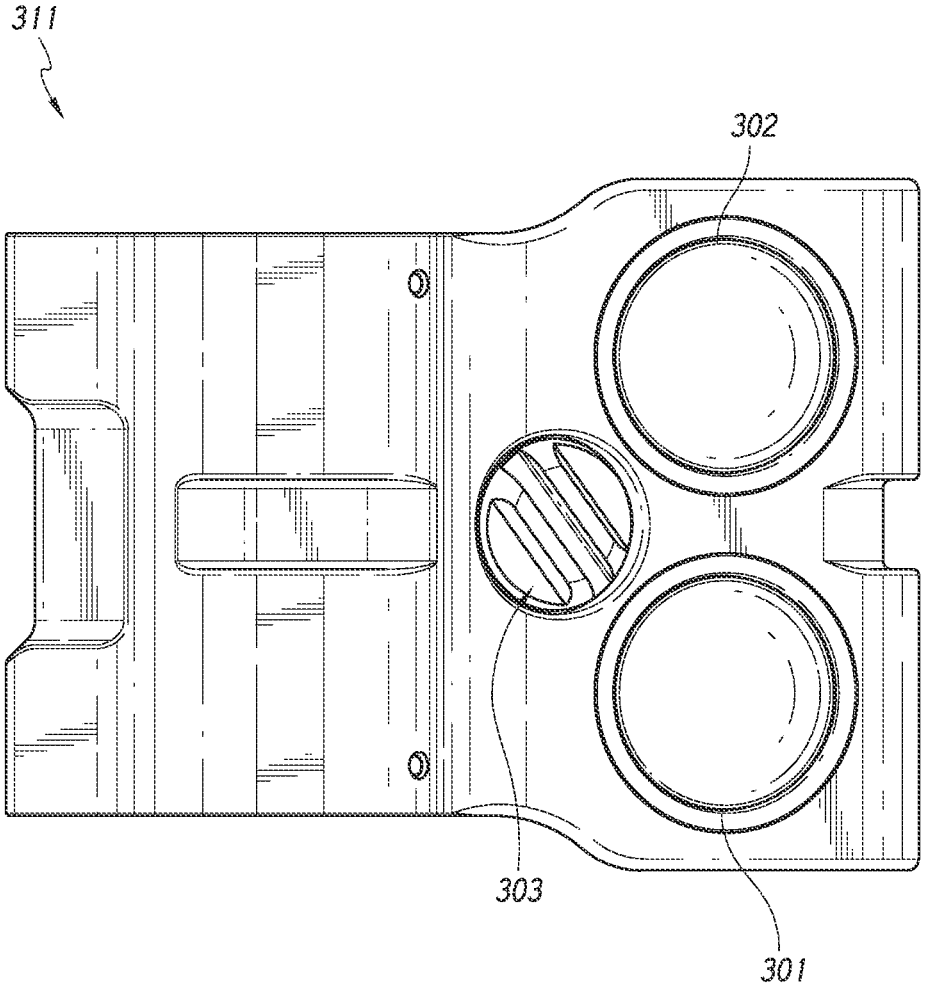
FIG. 3 depicts an example embodiment of a mounting module with low profile activation buttons.

FIG. 3 depicts an example mounting module 311 that may be configured to be combined with an optical head module and an end cap module. As described above with respect to FIGS. 1A and 1B, example mounting module 311 may include mounting screw 303 and activation buttons 301 and 302. As described above with respect to FIGS. 2A and 2B, mounting module 311 may be configured to allow for insertion of alignment rails in order to align modules that in combination comprise an illumination and aiming apparatus. Mounting module 311 may also be configured to be in electrical contact with other modules, for example, by accepting insertion of electrical contacts 218 from optical head module 210.

Figure 4A:
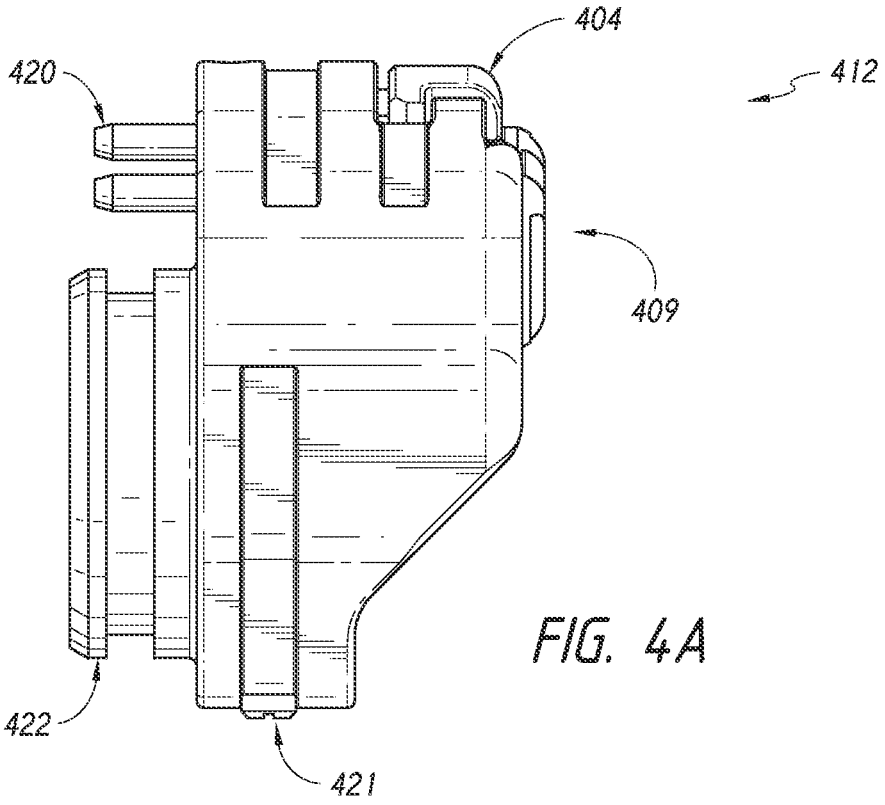
FIGS. 4A and 4B depict an example embodiment of an end cap module.
Figure 4B:
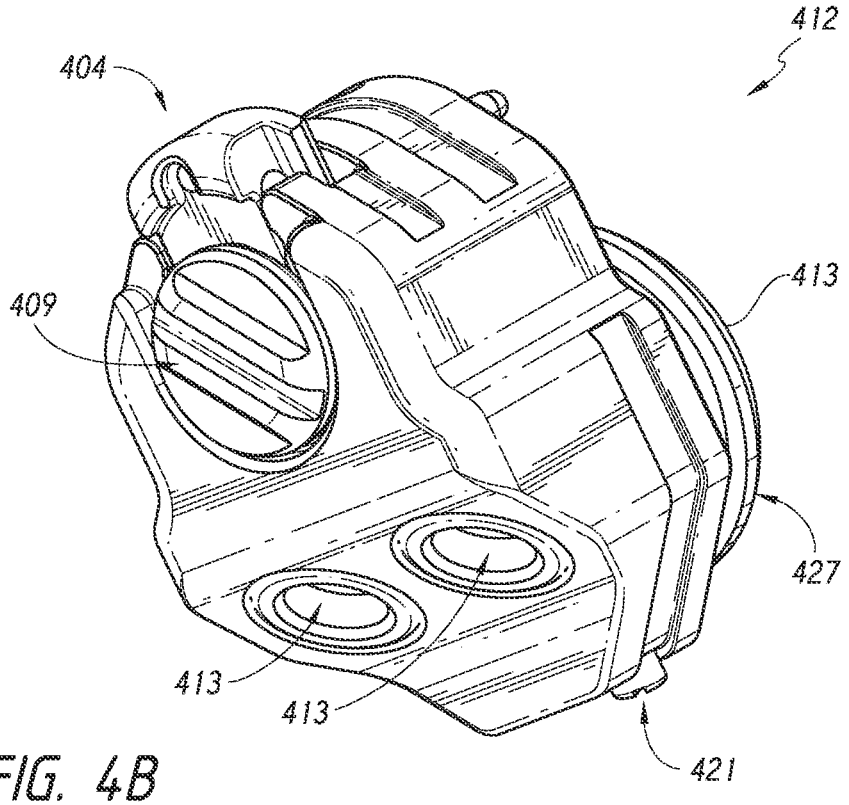

FIGS. 4A and 4B depict an example end cap module that may be configured to be combined with an optical head module and a mounting module. As described above with respect to FIGS. 1A and 1B, example end cap module 412 may include end cap screw 409, end cap latch 404, and remote fire switch ports 413. End cap module 412 may also include electrical contacts 420, lanyard screw 421, and sealing member 422.

Retention screw 421 may be configured to attach a retention wire or catch, so that when the user removes the end cap, for example to replace the voltage source, the end cap will remain connected to another object or module. Sealing member 422 may comprise an o-ring gasket, and may be configured to seal the chamber encasing the voltage source against the mounting module. Electrical contacts 420 may be configured to maintain the end cap module in electrical connection with other modules that are combined to comprise the illumination and aiming apparatus. As described above with respect to FIGS. 2A and 2B, alignment rails 219 from an optical head module may terminate in end cap module 412, and end cap latch 404 may be configured to latch into the alignment rails. When end cap screw 409 is tightened, end cap latch 404 may serve to lock the modules in place that comprise the illumination and aiming apparatus.

Figure 5A:
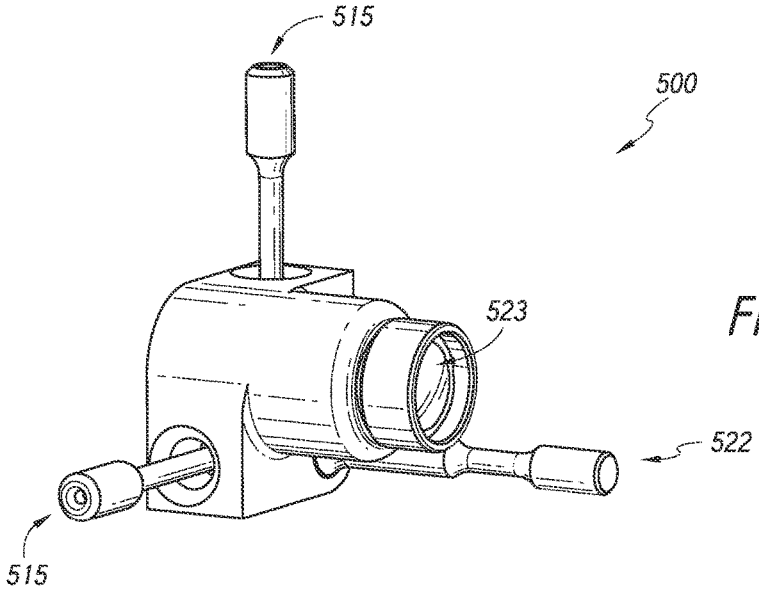
FIGS. 5A, 5B, and 5C depict an example embodiment of an optical assembly that may be configured to be integrated into an optical head module.
Figure 5B:
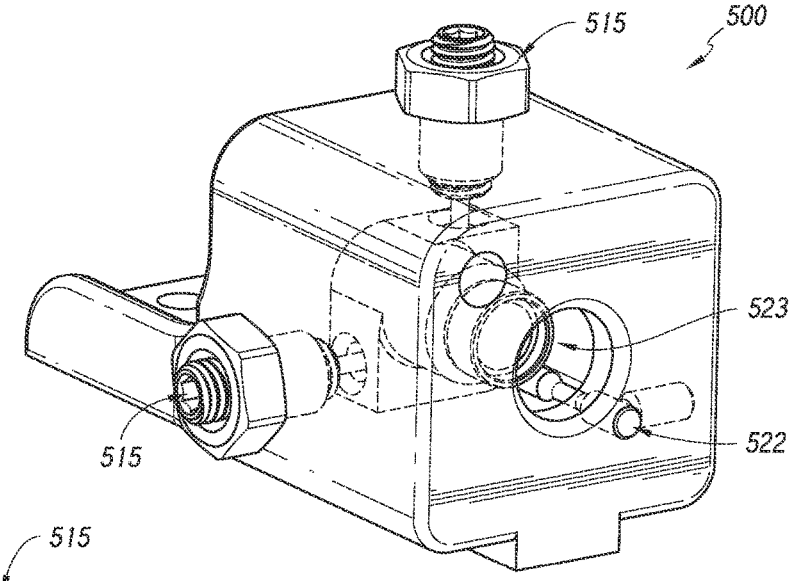
Figure 5C:
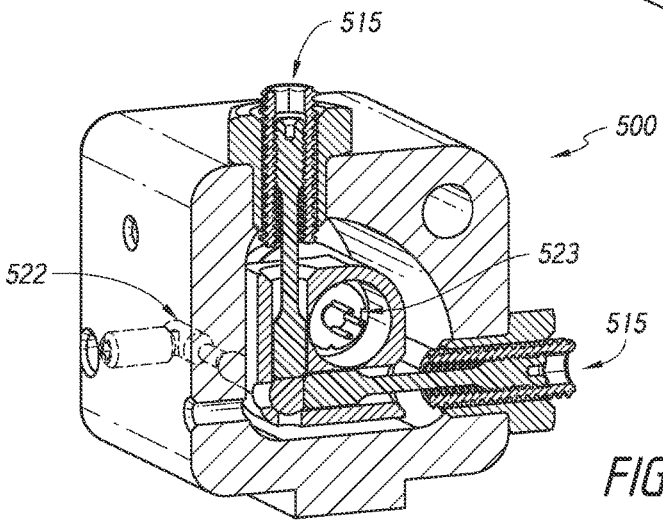

FIGS. 5A, 5B, and 5C depict optical assembly 500 that may be integrated into an optical head module, for example, optical head module 110 of FIGS. 1A and 1B or optical head module 210 of FIGS. 2A and 2B.

Optical assembly 500 is configured to provide alignment for the radiation sources that may be integrated into an optical head assembly. Optical assembly 500 may be configured to provide zero-play adjustment that is capable of maintaining zero movement of optics 523, even when subjected to heavy and sustained recoil, for example, as created by a firearm. Main flexure shaft 522 is configured to constrain optics 523 in an axial direction, while threaded flexure shafts 515 are configured to be adjusted to provide alignment of both azimuth (windage) and elevation of optical assembly 500. Adjusting threaded flexure shafts 515 allows the user to align the radiation sources so that the radiation sources may emit radiation in a direction parallel to the bore axis of the weapon on which the illumination and aiming apparatus is mounted. In an example embodiment, the divergence of the illumination radiation sources may be fixed. In other example embodiments, the divergence of the illumination radiation sources may also be adjusted by optical assembly 500. The threaded flexure shafts maintain the optics 523 under tension, thus eliminating any need for spring mounts and removing any possibility of free play or bounce from optics 523. In an example embodiment optics 523 may comprise both illumination and aiming radiation sources in combination with Risley prisms that are configured to allow the user to steer the aiming and illumination radiation in the desired direction.

As depicted in FIG. 5C, threaded flexure shafts 515 may comprise a compound thread system that is configured to allow a user to achieve the required resolution for radiation beam adjustment. Compound thread systems eliminate the need for unreasonably fine thread pitch that would be necessary to achieve comparable resolution in adjustment by exploiting a differential thread pitch of a first threaded flexure shaft element 524 and the adjoining second threaded flexure shaft element 525 to increase the effective thread pitch In one example embodiment, the optical source in optics 523 may comprise an array of VCSEL sources that are configured at fixed illumination power and divergences. These VCSEL sources may be configured to be used in combination to achieve desired illumination and aiming radiation as determined by the settings selected by the user. In other example embodiments, other radiation sources may be used such as LEDs, solid-state laser sources, arc lamps, etc.

The modules described above with respect to FIGS. 1-5 are understood to be exemplary. Other modules may be used in other embodiments of the application, and the modules may be selected by the user in order to meet specific environmental and mission requirements. For example, alternative to the optical head module described in FIGS. 1 and 2 may include functionalities based on white light illumination, short-wave infrared (SWIR) aiming and illuminating lasers, joint terminal attack controller (JTAC) marking lasers; laser range finders; hail and warning systems; long-range precision engagement aiming and illumination; crew-served weapon aiming and illumination, or even non-optical functionalities, such as TASER or oleoresin capsicum (QC) spray functions. Alternative end cap modules may include configurations that allow for remote power, alternative tape switch plug, additional direct fire buttons, a user interface display, or other mission-critical, user-selected options. Alternative mounting modules may include mounting configurations that are specific to the particular weapon or system upon which the illumination and aiming apparatus is to be mounted (e.g., M-LOK, KeyMOD, direct mount, etc.). As discussed above, alternative mounting modules may also include different button configurations, as appropriate to the head and end cap module functionalities, or other desired functions sets.

It will be appreciated that there exist additional advantages of using separate modules to comprise an illumination and aiming apparatus. Modularity allows damaged or outdated component modules to be individually replaced without the need to replace the entire apparatus. A user may also install separate mounting modules on multiple weapons, allowing the user to share the same end cap and optical head modules amongst multiple weapons.

It will also be appreciated that the preset combination of settings provided to the user by the positions of the end cap, the range switch, and the activation buttons are configured to allow the user to quickly identify the settings of the illumination and aiming apparatus. Because a user may be wearing gloves and/or be in a situation with limited visibility, it is important that the user be able to quickly identify the apparatus settings in order to quickly adjust to a changing environment or moving targets. Providing simple and intuitive setting options also minimizes the risk that the user may accidentally trigger a visible radiation mode that may inadvertently reveal the user's position.

Example functionalities of illumination and aiming device 100 will now be discussed in more detail with reference to FIGS. 6 and 7. As explained above, the following example configuration merely illustrates a possible combination of function sets, and is not intended to limit the scope of coverage of the application. FIG. 6 depicts a table of example function sets for which an example embodiment of illumination and aiming apparatus 100 can be configured. In all of the following examples, activation button 101 will be configured to provide the user with a mode that corresponds to an immediate threat, and activation mode 102 will be configured to provide the user with a mode that corresponds to a more administrative task.

When range switch 106 is fully extended over lock-out switch 107, illumination and aiming device 100 will be in the "long-range" mode for both the visible and IR radiation positions of lens cap 105. As FIG. 6 shows, in long-range mode, activation buttons 101 and 102 will provide different operation functions. In FIG. 6, activation button 102 is referred to as the "Front (KILL)" button, while activation button 101 is referred to as the "Rear (ADMIN)" BUTTON. In this example mode, activation button 102 is configured to provide both a high power, 15 mW aiming pointer beam and a high power 150 mW narrow illumination beam with 4 degrees divergence. Activation button 101 is configured to provide only a 15 mW aiming beam without illumination. In this example, the aiming beam has a range exceeding 1000 meters, and the illumination beam will have a range of approximately 400 meters. This mode provides function sets that will likely be useful to a user in an exterior environment, engaging with targets at a distance.

When range switch 106 is in the middle position, illumination and aiming device will be in the "mid-range" mode for both the visible and IR radiation positions of lens cap 105. In this example mid-range mode, activation button 102 is configured to provide both a medium power, 10 mW aiming pointer beam in combination with a high power, wide spill, 20 mW illumination beam with 4 degrees divergence and a 150 mW illumination beam with 16 degrees divergence. Activation button 101 is configured to provide a medium power, 10 mW aiming pointer beam in combination with a low power, wide spill 80 mW illumination beam with 4 degrees divergence and a 40 mW illumination beam with 16 degrees divergence. In this example, the aiming pointer beam has a range of approximately 500 meters, while the illumination beams have a range of approximately 50 to 100 meters. This mode of the illumination and aiming device provides function sets that could be used in both exterior and interior settings, where a target is likely to be engaged at a middle distance.

When range switch 106 is in the position that is closest to the user, illumination and aiming device 100 will be in the "short-range" mode for both the visible and IR radiation positions of lens cap 105. As FIG. 6 shows, in short-range mode, activation buttons 101 and 102 will provide different operation functions. In this example mode, activation button 102 is configured to provide both a low power, 1 mW aiming pointer beam and a smooth 40 mW illumination beam with 60 degrees divergence. Activation button 101 is configured to provide only a 5 mW illumination beam with 60 degrees divergence intended for use as a navigation light for covert maneuvering through difficult terrain. In this example, the aiming beam has a range of approximately 100 meters, and the illumination beam will have a range of approximately 0-15 meters. This mode of the illumination and aiming device provides function sets that could be used in environments where the user is likely to immediately engage with a target, for example, in a room clearing scenario.

It will be appreciated that the user will be able to quickly and easily switch between these function sets, and as such quickly adapt to a changing environment and changing target distance.

Figure 7:
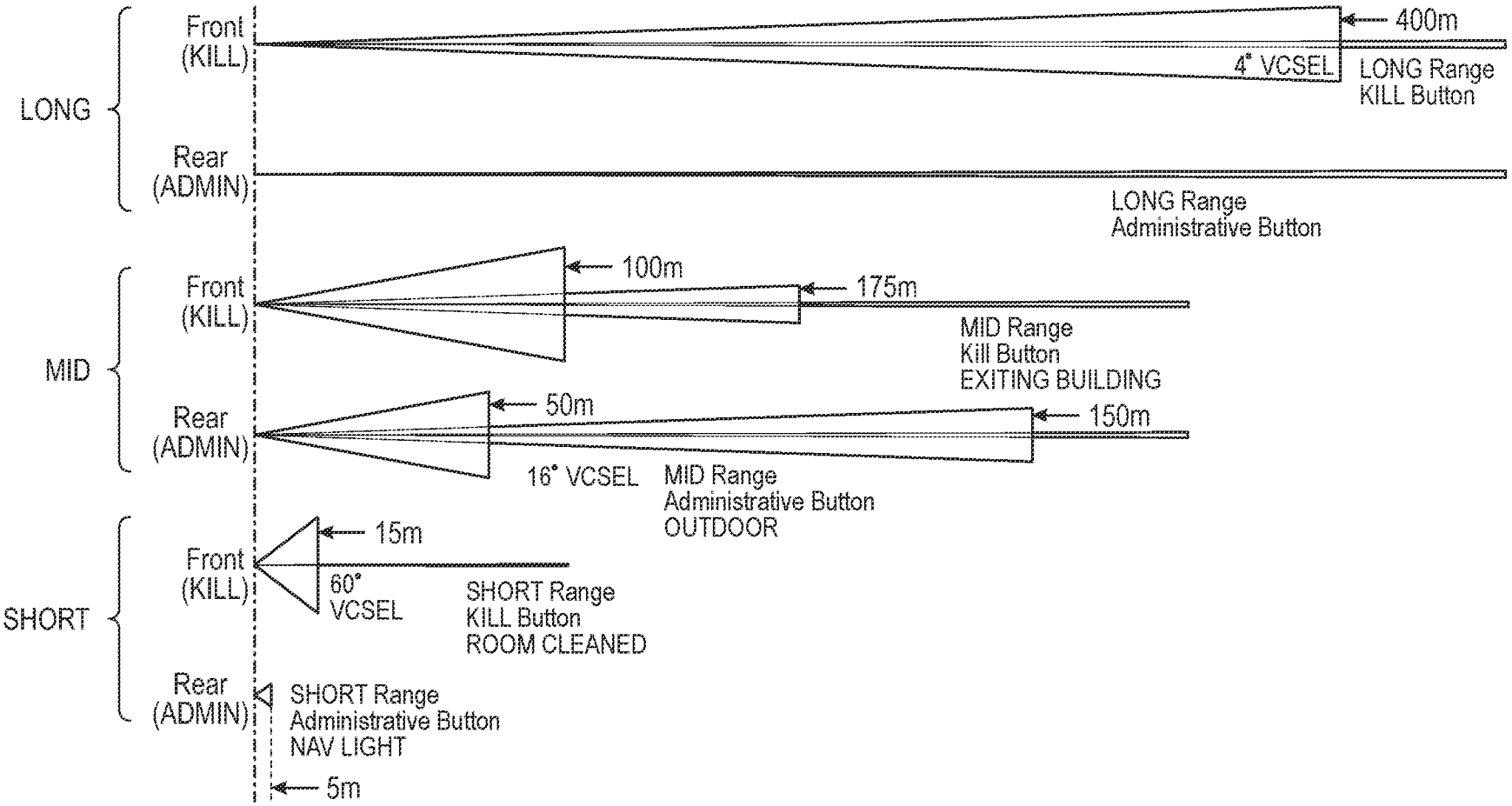
FIG. 7 illustrates the illumination and aiming radiation as described in the table of FIG. 6.

FIG. 7 provides a visual depiction of the different radiation modes described above with respect to the table of FIG. 6. As illustrated, the differing ranges and divergence angles of the combinations of radiation sources provided by each operation function set can be seen relative to each other. As illustrated in FIG. 7, the illumination and aiming radiation provided in each operation function set may substantially share the same optical axis.

Although a number of example embodiments of the application have been described, it should be understood that numerous other modifications and embodiments of the application can be devised by those skilled in the art that will fall within the scope of the principles of this disclosure. More particularly, various variations and modifications are possible in the component parts and/or arrangements of the subject matter within the scope of the disclosure, the drawings, and the appended claims. In addition to variations and modifications in the component parts and/or arrangements, alternative uses and applications of the example embodiments will also be apparent to those skilled in the art.

What is claimed is:

1. An apparatus, comprising:

a mounting module that facilitates mounting the apparatus to an object in a selected orientation with reference to the object, the selected orientation being selected from a group of orientations comprising at least a first orientation and a second orientation that is not the first orientation; and activation buttons positioned on the mounting module, wherein an activation button of the activation buttons facilitates a first light emission function in response to the apparatus being determined to be mounted to the object in the first orientation, and wherein the activation button facilitates a second light emission function, different from the first light emission function, in response to the apparatus being determined to be mounted to the object in the second orientation.

2. The apparatus of claim 1, wherein:

the activation button of the activation buttons is a first activation button;

the activation buttons further comprise a second activation button;

in response to the apparatus being determined to be mounted to the object in the first orientation, the first activation button facilitates the first operation function and the second activation button facilitates the second operation function; and in response to the apparatus being determined to be mounted to the object in the second orientation, the first activation button facilitates the second operation function and the second activation button facilitates the first operation function.

3. The apparatus of claim 1, wherein the object is a firearm, and wherein the mounting module facilitates mounting the apparatus to a rail system of the firearm.

4. The apparatus of claim 3, wherein the mounting module further facilitates mounting at least a portion of the apparatus off-axis relative to a central axis of the firearm.

5. The apparatus of claim 1, wherein the activation button causes the first operation function to be performed in response to the activation button being determined to have been clicked, and wherein the activation button causes a third operation function to be performed in response to the activation button being determined to have been double clicked.

6. The apparatus of claim 5, wherein the activation button causes the first operation function to be halted in response to the activation button being determined to have been released, and wherein the activation button causes the third operation function to be performed in a continuous on state in response to the activation button being determined to have been double clicked.

7. The apparatus of claim 1, wherein:

the first operation function causes the apparatus to emit a light beam having a beam property set to a first value, the second operation function causes the apparatus to emit the light beam having the beam property set to a second value that is not the first value, and the beam property is selected from a group of properties comprising an output power, an angular beam divergence, a light wavelength, and a pulse width.

8. The apparatus of claim 1, wherein the first operation function causes the apparatus to emit a continuous light beam, and wherein the second operation function causes the apparatus to emit a pulsed light beam.

9. The apparatus of claim 1, further comprising:

a range switch communicatively coupled to the mounting module and positionable in at least a first position and a second position, wherein, in response to the range switch being determined to be positioned in the first position, the activation button facilitates a first group of operation functions comprising the first operation function and the second operation function, and wherein, in response to the range switch being determined to be positioned in the second position, the activation button facilitates a second group of operation functions comprising a third operation function and a fourth operation function.

10. The apparatus of claim 1, wherein the object is a vehicle.

11. A method, comprising:

determining, by a system comprising at least one processor, an orientation of an apparatus with respect to an object to which the apparatus is mounted in response to determining that an activation button, of activation buttons associated with the apparatus, has been pressed;

selecting, by the system based on the orientation of the apparatus, a light emission function to be performed by the apparatus from a group of functions comprising a first light emission function and a second light emission function that is not the first light emission function, resulting in a selected light emission function.

12. The method of claim 11, wherein:

the activation buttons comprise a first activation button and a second activation button, in response to the activation button being determined to be the first activation button, the selecting comprises:

selecting the first light emission function as the selected light emission function in response to the orientation of the apparatus being determined to be a first orientation; and selecting the second light emission function as the selected light emission function in response to the orientation of the apparatus being determined to be a second orientation that is not the first orientation, and in response to the activation button being determined to be the second activation button, the selecting comprises:

selecting the second light emission function as the selected light emission function in response to the orientation of the apparatus being determined to be the first orientation; and selecting the first light emission function as the selected light emission function in response to the orientation of the apparatus being determined to be the second orientation.

13. The method of claim 11, further comprising:

determining, by the system, a position of a range switch associated with the apparatus in response to the determining that the activation button has been pressed, wherein the selecting of the selected light emission function is further based on the position of the range switch.

14. The method of claim 11, further comprising:

causing, by the system, the apparatus to perform the light emission function while the activation button is determined to be pressed; and causing, by the system, the apparatus to cease the light emission function in response to determining that the activation button has been released.

15. The method of claim 11, further comprising:

causing, by the system, the apparatus to continuously perform the selected light emission function in response to determining that the activation button has been double clicked.

16. The method of claim 11, wherein the first light emission function is a pointer function, and wherein the second light emission function is an illumination function.

17. The method of claim 11, wherein the first light emission function is associated with continuous light emission, and wherein the second light emission function is associated with pulsed light emission.

18. An apparatus, comprising:

means for mounting the apparatus to an object in a selected orientation with reference to the object, the selected orientation being selected from a group of different orientations comprising at least a first orientation and a second orientation; and means for activating operations coupled to the means for mounting, wherein, in response to the apparatus being determined to be mounted to the object in the first orientation, activation of the means for activating facilitates performance of a first light emission function by the apparatus, and wherein, in response to the apparatus being determined to be mounted to the object in the second orientation, activation of the means for activating facilitates performance of a second light emission function by the apparatus, different from the first light emission function.

19. The apparatus of claim 18, wherein performance of the first operation comprises emitting a beam of light with a beam property set to a first value, and wherein performance of the second operation comprises emitting the beam of light with the beam property set to a second value that is not the first value.

20. The apparatus of claim 19, wherein the beam property is selected from a group of properties comprising a power level, a light wavelength, an angular beam divergence, and a pulse width.

* * * * *